US005382062A

United States Patent [19]

Köstler

[11] Patent Number: 5,382,062

[45] Date of Patent: Jan. 17, 1995

[54] MOTOR-VEHICLE DOOR LATCH WITH COLLISION PROTECTION

[75] Inventor: Ulrich Köstler, Hebertshausen, Germany

[73] Assignee: Kiekert GmbH & Co. KG, Heiligenhaus, Germany

[21] Appl. No.: 66,942

[22] Filed: May 24, 1993

[30] Foreign Application Priority Data

May 23, 1992 [DE] Germany ..... 4217140

[51] Int. Cl.[6] ..... F05B 15/02

[52] U.S. Cl. ..... 292/340; 49/394; 292/DIG. 65; 292/DIG. 23

[58] Field of Search ..... 202/216, 341.15, 341.17, 202/340, DIG. 23, DIG. 65; 49/394 X

[56] References Cited

U.S. PATENT DOCUMENTS

| | | | |
|---|---|---|---|
| 4,624,491 | 11/1986 | Vincent | 292/216 |
| 4,856,829 | 8/1989 | Nakamura et al. | 392/216 |
| 4,998,759 | 3/1991 | Peterson et al. | 292/340 |
| 5,125,698 | 6/1992 | Thau | 292/340 |
| 5,209,532 | 5/1993 | Nakamura et al. | 292/340 |
| 5,263,752 | 11/1993 | Phail-Fausey et al. | 292/216 |

FOREIGN PATENT DOCUMENTS

| | | | |
|---|---|---|---|
| 2352713 | 4/1975 | Germany | 292/DIG. 65 |

*Primary Examiner*—Peter M. Cuomo
*Assistant Examiner*—Darnell M. Boucher
*Attorney, Agent, or Firm*—Herbert Dubno; Andrew Wilford

[57] ABSTRACT

A motor-vehicle latch mounted on a door has a front end pivoted about an upright axis, a rear end with a rearwardly directed end face, and an inside face immediately adjacent the rear end face, the door being movable relative to a frame member having a forwardly directed front face confronting the rear end face of the door in a fully closed position of the door. A holding element fixed to the front face of the frame member has a part projecting inward past the inside face of the door in the fully closed position of the door and having a support face facing forward toward the rear end face of the door. A retaining member, for example a bolt or wedge, is fixed in the holding element and a retaining element on the rear end face of the door is engageable with the retaining member to latch the door in the fully closed position. The part of the holding element projecting inward past the inside face of the door in the fully closed position thereof is formed with a forwardly directed bump lying inward of the inside face of the door in the fully closed position so that if the door is pushed back in a collision the inner face of the door will be prevented by the bump from sliding inward over the end of the holding element.

8 Claims, 1 Drawing Sheet

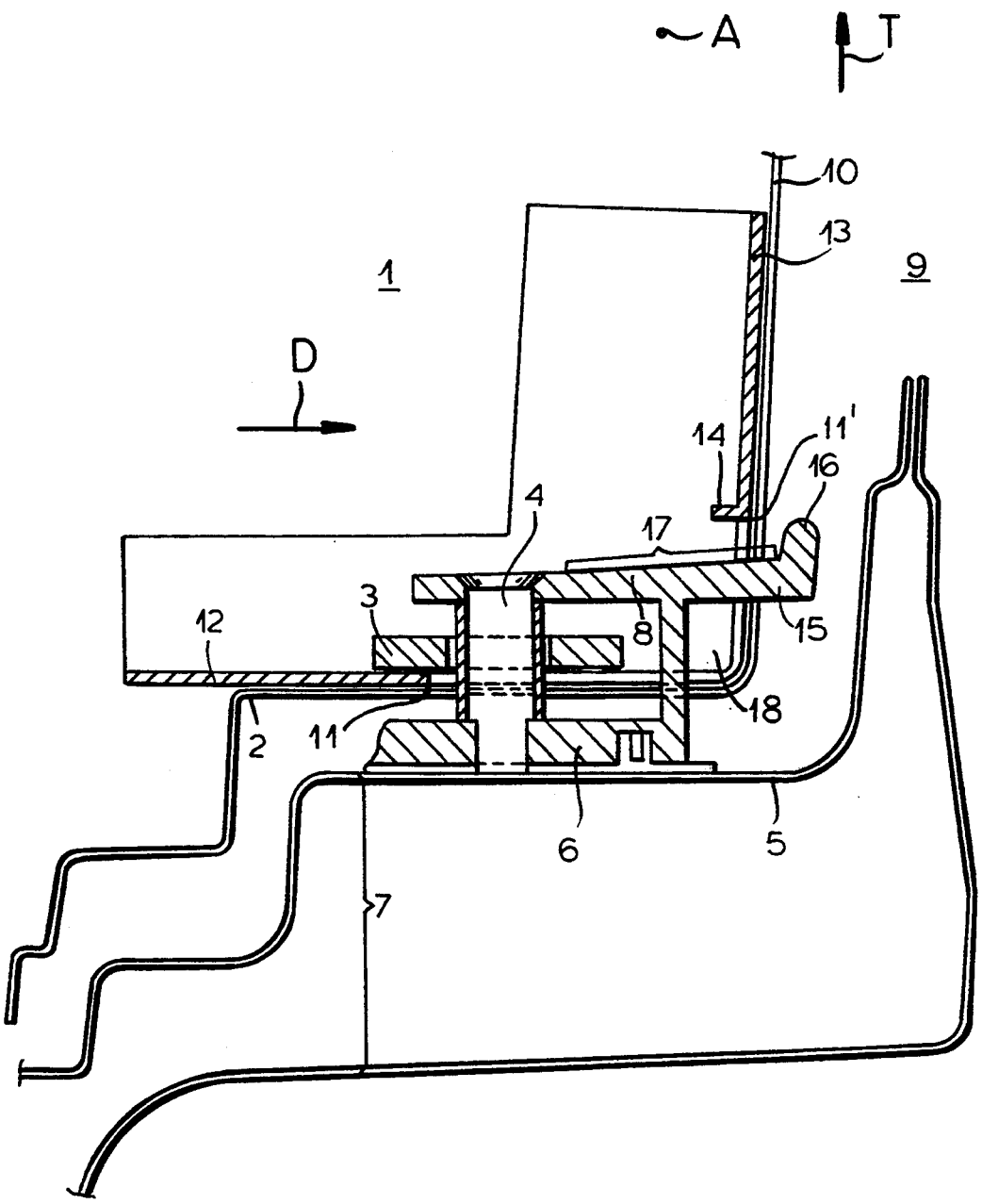
A
T
10
13
1
9
D
14
11'
16
4
17
3
8
15
12
18
2
11
6
5
7

MOTOR-VEHICLE DOOR LATCH WITH COLLISION PROTECTION

FIELD OF THE INVENTION

The present invention relates to a motor-vehicle door latch. More particularly this invention concerns such a latch used on a side door.

BACKGROUND OF THE INVENTION

A motor-vehicle door has a front end pivoted about an upright axis, a rear end with a rearwardly directed end face, and an inside face immediately adjacent the rear end face. The door is pivotal about the axis relative to a frame member having a forwardly directed front face confronting the rear end face of the door in a fully closed position of the door. A holding element fixed to the front face of the frame member has a part projecting inward past the inside face of the door in the fully closed position of the door and having a support face facing forward toward the rear end face of the door. A retaining member, for example a bolt or wedge, is fixed in the holding element and a retaining element on the rear end face of the door is engageable with the retaining member to latch the door in the fully closed position.

As described in German patent document 3,240,532 the support surface of a housing-like holder extends laterally further into the interior of the vehicle seen from above as the inner surface of the door or the covering thereof. This structure is intended, when the door is pushed back in an accident, to prevent the inner face of the door from hooking on the holder. When, however, the force of the accident is extreme so that the door is driven back considerably, the inner face of the door can be driven in and hook on the holder.

OBJECTS OF THE INVENTION

It is therefore an object of the present invention to provide an improved motor-vehicle door latch.

Another object is the provision of such an improved motor-vehicle door latch which overcomes the above-given disadvantages, that is which prevents the door from hooking on the post-mounted holder even in serious accidents.

SUMMARY OF THE INVENTION

The instant invention is an improvement on a motor-vehicle latch mounted on a door having a front end pivoted about an upright axis, a rear end with a rearwardly directed end face, and an inside face immediately adjacent the rear end face, the door being movable relative to a frame member having a forwardly directed front face confronting the rear end face of the door in a fully closed position of the door. A holding element fixed to the front face of the frame member has a part projecting inward past the inside face of the door in the fully closed position of the door and having a support face facing forward toward the rear end face of the door. A retaining member, for example a bolt or wedge, is fixed in the holding element and a retaining element on the rear end face of the door is engageable with the retaining member to latch the door in the fully closed position. According to the invention the part of the holding element projecting inward past the inside face of the door in the fully closed position thereof is formed with a forwardly directed bump lying inward of the inside face of the door in the fully closed position so that if the door is pushed back in a collision the inner face of the door will be prevented by the bump from sliding inward over the end of the holding element.

This extremely simple expedient effectively prevents the door from hooking over the holding element of the latch even in a severe collision, in which the door is pushed back and in simultaneously. The rear inner edge of the door hangs up on the bump of the holding element in every case, preventing it from riding in and back over this edge.

According to another feature of the invention the support face of the holding element is inclined backward away from the door. Thus even if the rear edge of the inner face of the door has been driven back into actual contact with this support surface, any outward movement of the door will create a gap between the edge and the surface, making it easy to open the door.

Furthermore in accordance with this invention an L-shaped mounting plate carrying the retaining element is formed with an inwardly and rearwardly open notch in which the holding element engages in the fully closed position of the door. The notch has a front edge engageable with the support face of the holding element when the door is driven back, as in a collision. This front edge has a laterally outwardly bent lip that ensures some surface contact between the notch edge and the support surface to prevent the edge from biting into this support surface. The mounting plate is L-shaped and has a rear flange extending along the rear end face of the door.

BRIEF DESCRIPTION OF THE DRAWING

The above and other objects, features, and advantages will become more readily apparent from the following description, reference being made to the accompanying drawing whose sole FIGURE is a horizontal section seen from above through a motor vehicle latch according to the invention.

SPECIFIC DESCRIPTION

As seen in the drawing a motor-vehicle door 1 is normally hinged about an upright axis indicated at A that lies at the front of the door 1 relative to the vehicle's normal direction of travel T. The door 1 has a generally vertical inside face 10 and a similarly vertical rear-edge surface 2 that confronts a vertical front-edge surface 5 of a door post 7. The rear inside corner of the door 1 where the door edge face 2 meets the inner face 10 is formed with a rearwardly and inwardly open cutout or notch 18 having rear and front edges 11 and 11' and in which is provided a pivotal fork 3 that can engage over a bolt 4 projecting horizontally forward from the face 5 to hold the door 1 in the illustrated closed position. An unillustrated release pawl acting on the fork 3 as well as inside and outside lock mechanisms operate the fork in the manner well known in the art.

According to the invention the bolt 4 is carried on a cast metal holder block 6 having a front flange 8 extending inwardly in a direction D the door 1 closes in past the inside face 10 of the door 1. This front flange 8 therefore extends inward out of the notch 18 past the door 1 and has an inner end 15 formed with a forwardly directed bump 16 having a free end as shown in the FIGURE. The fork 3 and the other unillustrated parts of the door latch are mounted on an L-shaped latch plate 12 having an inner flange 13 lying against the outside face of the inside door panel 10 and having a bent-out lip 14 at a rearwardly directed edge 11' of the notch 18.

Thus in a collision when, as is typical, the entire door 1 is driven back against the direction T, the edge 11' of the notch 18 will strike a front face 17 of the flange 8. The bump 16 will engage inward of the inner door panel 10 so that even if the door 1 is then driven somewhat inward in the direction D, the panel 10 will catch on the bump 16 and will not move inward past the inner portion 15 of the flange 8.

Furthermore according to the invention the surface 17 is angled somewhat back and out so that if the door 1 is jammed back, it can be freed once it is unlatched even if the edge 11' is directly engaged against the surface 17. The smallest outward movement of the door 1 against direction D will normally disengage the edge 11' from the surface 17.

I claim:

1. In a motor-vehicle latch assembly comprising:

a door having a front end pivoted about an upright axis, a rear end with a rearwardly directed end face, and an inside face immediately adjacent the rear end face;

a frame member having a forwardly directed front face confronting the rear end face of the door in a fully closed position of the door;

a holding element fixed to the front face of the frame member and having a part projecting inward past the inside face of the door in the fully closed position of the door and having a support face facing forward toward the rear end face of the door;

a retaining member fixed in the holding element; and means including a retaining element on the rear end face of the door engageable with the retaining member to latch the door in the fully closed position; the improvement wherein the holding element is fixed solely to and extends forward from the front face of the frame member, the part of the holding element projecting inward past the inside face of the door in the fully closed position thereof is formed with a forwardly directed bump lying inward of the inside face of the door in the fully closed position, said bump having a free end, whereby if the door is pushed back in a collision the inner face of the door will be prevented by the free end of the bump from sliding inward over the end of the holding element.

2. The improved latch assembly defined in claim 1 wherein the support face of the holding element is inclined backward away from the door.

3. The improved latch assembly defined in claim 1 wherein the means including the retaining element includes an L-shaped mounting plate formed with an inwardly and rearwardly open notch in which the holding element engages in the fully closed position of the door.

4. The improved latch assembly defined in claim 3 wherein the notch has a front edge engageable with the support face of the holding element when the door is driven, as in a collision, back.

5. The improved latch assembly defined in claim 4 wherein the front edge has a laterally bent lip.

6. The improved latch assembly defined in claim 4 wherein the mounting plate has a rear flange extending along the rear end face of the door.

7. The improved latch assembly defined in claim 1 wherein the frame member has a forwardly projecting flange with an outside face confronting the inside face of the door, the holding element being out of contact with and spaced from the flange.

8. In a motor-vehicle latch assembly comprising:

a door having a front end pivoted about an upright axis, a rear end with a rearwardly directed end face, and an inside face immediately adjacent the rear end face;

a frame member having a forwardly directed front face confronting the rear end face of the door in a fully closed position of the door and a forwardly projecting flange with an outside face confronting the inside face of the door in the fully closed position of the door;

a holding element fixed to the front face of the frame member and having a part projecting inward past the inside face of the door in the fully closed position of the door and having a support face facing forward toward the rear end face of the door;

a retaining member fixed in the holding element; and means including a retaining element on the rear end face of the door engageable with the retaining member to latch the door in the fully closed position; the improvement wherein the holding element is fixed solely to and extends forward from the front face of the frame member, the part of the holding element projecting inward past the inside face of the door in the fully closed position thereof is formed with a forwardly directed bump lying inward of the inside face of the door in the fully closed position, whereby if the door is pushed back in a collision the inner face of the door will be prevented by the bump from sliding inward over the end of the holding element, and the holding element is out of contact with and spaced from the flange.

* * * * *